US007400339B2

(12) United States Patent
Sampath et al.

(10) Patent No.: US 7,400,339 B2
(45) Date of Patent: Jul. 15, 2008

(54) METHOD AND SYSTEM FOR AUTOMATICALLY COMPENSATING FOR DIAGNOSED BANDING DEFECTS PRIOR TO THE PERFORMANCE OF REMEDIAL SERVICE

(75) Inventors: Meera Sampath, Penfield, NY (US); Howard A. Mizes, Pittsford, NY (US); Susan Zoltner, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 292 days.

(21) Appl. No.: 10/956,209

(22) Filed: Sep. 30, 2004

(65) Prior Publication Data

US 2006/0071963 A1 Apr. 6, 2006

(51) Int. Cl.
*B41J 2/47* (2006.01)

(52) U.S. Cl. ..... 347/251; 347/240

(58) Field of Classification Search ..... 399/46, 399/53, 60, 26–27, 72–74, 301, 15, 48–49, 399/24, 34; 347/228, 115–116, 236–240, 347/246–255; 359/204; 358/3.1; 382/112
See application file for complete search history.

(56) References Cited

U.S. PATENT DOCUMENTS 3,788,739 A 1/1974 Coriale
5,055,860 A * 10/1991 Bannai ..... 347/249
5,204,620 A 4/1993 Costanza et al.
5,313,254 A 5/1994 Temple
5,406,379 A * 4/1995 Kingsley et al. ..... 358/3.1
5,481,337 A * 1/1996 Tsuchiya et al. ..... 399/46
5,546,165 A 8/1996 Rushing et al.
5,671,078 A * 9/1997 Mirchandani ..... 359/204
5,729,277 A * 3/1998 Morrison ..... 347/248
5,754,918 A 5/1998 Mestha et al.
5,777,656 A 7/1998 Henderson
5,854,653 A * 12/1998 Derrick ..... 347/255
5,859,658 A 1/1999 Hammond
5,900,901 A 5/1999 Costanza et al.
5,920,336 A 7/1999 Lawton et al.
6,198,885 B1 * 3/2001 Budnik et al. ..... 399/24

(Continued)

FOREIGN PATENT DOCUMENTS

EP 0 565 328 10/1993

(Continued)

*Primary Examiner*—Hai C Pham
(74) *Attorney, Agent, or Firm*—Maginot, Moore & Beck

(57) ABSTRACT

A system that extends the operational effectiveness of an image reproduction machine without requiring downtime for service by personnel includes a detection subsystem that monitors components of an image reproduction system for detecting a banding defect in the image reproduction system and an automated compensation subsystem for modifying operation of the image reproduction system to compensate for the detected banding defect so that the image reproduction system continues to generate images at an acceptable quality level. The automated compensation subsystem adjusts components and/or data used by image reproduction system to compensate for the identified banding defect without requiring immediate operator or service personnel intervention. This compensation may successfully attenuate the banding defect so that the image reproduction system continues to produce acceptable images without downtime while awaiting service by personnel. The system may also include a diagnostic subsystem for determining causes for a detected banding defect to further enhance the operation of the compensation system or to facilitate a repair action by a person.

20 Claims, 11 Drawing Sheets

U.S. PATENT DOCUMENTS

| | | | | |
|---|---|---|---|---|
| 6,272,295 | B1 * | 8/2001 | Lindblad et al. | 399/26 |
| 6,275,600 | B1 * | 8/2001 | Banker et al. | 382/112 |
| 6,377,761 | B1 * | 4/2002 | Nichols | 399/34 |
| 6,608,643 | B2 * | 8/2003 | Lofthus et al. | 347/240 |
| 6,697,582 | B1 * | 2/2004 | Scheuer | 399/49 |
| 6,862,414 | B2 * | 3/2005 | Sampath et al. | 399/15 |
| 6,885,833 | B2 * | 4/2005 | Stelter et al. | 399/48 |
| 2002/0171697 | A1 | 11/2002 | Gargir et al. | |
| 2003/0117484 | A1 | 6/2003 | Vazan | |
| 2003/0142985 | A1 | 7/2003 | Sampath et al. | |
| 2004/0008245 | A1 | 1/2004 | Hirai et al. | |
| 2005/0265739 | A1 * | 12/2005 | Hamby et al. | 399/49 |

FOREIGN PATENT DOCUMENTS

| | | |
|---|---|---|
| EP | 1 574 909 | 9/2005 |
| JP | 03 233475 | 10/1991 |

* cited by examiner

METHOD AND SYSTEM FOR AUTOMATICALLY COMPENSATING FOR DIAGNOSED BANDING DEFECTS PRIOR TO THE PERFORMANCE OF REMEDIAL SERVICE

FIELD OF THE INVENTION

The present invention relates generally to diagnostic systems for identifying banding defects in digital image reproduction systems, and more particularly, to such diagnostic systems that prescribe a corrective action to remedy the identified banding defect.

BACKGROUND OF THE INVENTION

Digital image reproduction systems are well-known. These systems typically include a digital document generator that may be coupled to the reproduction system directly or through a computer network. Digital document generators include computers, scanners, or other devices that store or permit a user to define content for a digital document. The digital data are provided to a print engine so the controller of the engine may control the process. The reproduction system also includes a photoreceptor belt or drum that provides a rotating surface for the exposure, development, and transfer of a latent image that corresponds to the digital document.

The latent image exposure begins with the charging of a portion of the photoreceptor belt at a charging station. The charged portion of the belt is advanced through an imaging/exposure station, where the data digital are provided as a signal to a raster output scanner. The raster output scanner selectively discharges the charged portion of the photoreceptor belt to form the latent image in correspondence with the document digital data. Development of the latent image occurs with the advancing of the photoreceptor belt to a development station where toner is attracted to the exposed latent image on the photoreceptor belt. More than one development station may be used for the development of color images so that different color toner materials may be applied to the latent image. Once the latent image is developed, the belt rotates to a transfer station where the toner on the latent image contacts a sheet medium, such as a sheet of paper. Typically, a corona generating device generates a charge on the backside of the sheet medium so the toner particles are attracted to the sheet medium and migrate from the latent image to the sheet medium. A detack unit removes the sheet medium from the photoreceptor belt and the belt moves through a cleaning station to remove the residual toner particles so that portion of the belt may be used for development of another latent image. The sheet medium impregnated with toner particles moves to a fuser station where fuser and pressure rollers permanently fuse the toner particles to the sheet medium. The sheet medium is then directed to a catch tray for the accumulation of sheets bearing the images of the digital documents sent to the reproduction system.

To provide data for the control of this reproduction process, one or more densitometers or enhanced toner area coverage (ETAC) sensors may be provided after the development station(s) to measure the developed mass of toner applied to a unit area, sometimes called developed mass per unit area (DMA), on the photoreceptor belt or drum. The ETAC sensor includes one or more light emitting diodes (LEDs) for emitting light at a particular wavelength, which is preferably in the infrared range. The LEDs of the ETAC sensor are oriented at a particular angle with respect to the photoreceptor belt so that the emitted light is reflected by the toner on the photoreceptor belt and one or more photodetectors are located at the reflection angle to receive the light reflected from the photoreceptor belt. Typically, the latent image includes a toner control patch so the emitted light impinges on an area having toner to produce the toner density measurements. The voltage signal generated by a photodetector may be used to determine the DMA for the application of toner to the photoreceptor belt or drum.

The photodetectors are located in the area of reflected light so that one or more of the photodetectors receive specular light reflected from the photoreceptor. Other photodetectors are located so that they receive diffuse light reflected from the applied toner. The photodetectors generate a voltage signal that corresponds to the amount of light received by the photodetector. Thus, the photodetectors provide a specular measurement and a diffuse measurement. The specular measurement refers to light reflected by bare photoreceptor within the toner patch that presents a mirror surface to the emitted light, while the diffuse measurement refers to light reflected by the toner patch that is uneven and diffuses the emitted light from the LEDs. Both signals are important for reproduction control because the specular measurement is self-calibrating with LED intensity variations but saturates at typical solid area masses while the diffuse measurement remains sensitive to toner mass as it increases but is altered by LED intensity variations. Consequently, the specular signal has good signal to noise ratio characteristics for low DMA levels, while the diffuse signal has good signal to noise ratio characteristics for high DMA levels.

A controller for a print engine in a digital reproduction system may use the specular and diffuse measurements received from the ETAC sensors to detect degradation in the quality of the images being reproduced by the system. One commonly encountered image defect is a class of defects known as banding defects. These defects produce lines, streaks, or bands extending across the image. These defects may occur in the direction of the image production process or perpendicular to the process direction. The effects of the defects may appear in images periodically or non-periodically. The banding defects are typically the result of worn or damaged parts, foreign matter, electrical malfunctions, vibrations, or component misalignment in the print engine and associated feed mechanisms and controls.

In published U.S. Patent Application 2003/0142985 entitled Automated Banding Defect Analysis And Repair For Document Processing Systems filed on Jan. 30, 2002, which is commonly owned by the assignee of this patent and the entire disclosure of which is hereby expressly incorporated herein by reference in its entirety, a system for detecting banding errors and identifying a remedial service procedure is disclosed. That system uses a number of diagnostic techniques to detect banding errors and identify a cause for the banding error. Some of the remedial measures may be performed by the operator or other on-site personnel, while some remedial measures must be performed by service technicians. By identifying remedial measures that may be performed by an operator or other on-site personnel, downtime is reduced and unnecessary service calls are avoided.

One issue with the analysis and repair system is the cost of repair. That is, the remedial measures identified by the system typically require replacement of parts or adjustment of existing parts. These procedures require some human intervention and some downtime for the reproduction machine. The remedial measures, in some cases, are overkill because the cost of new part may not be warranted since the image defect may be tolerable. Consequently, the analysis and repair system may result in the removal and discarding of reproduction machine parts before they have lost their full operational effectiveness.

SUMMARY OF THE INVENTION

The present invention addresses the need for extending the operational effectiveness of an image reproduction machine without requiring downtime for service by personnel. A system implementing the principles of the present invention includes a detection subsystem coupled to an image reproduction system for detecting a banding defect in the image reproduction system and an automated compensation subsystem for modifying operation of the image reproduction system to compensate for the detected banding defect so that the image reproduction system continues generate images at an acceptable quality level. The automated compensation subsystem adjusts components and/or data used by image reproduction system to compensate for the identified banding defect without requiring immediate operator or service personnel intervention. This compensation may successfully attenuate the banding defect so that the image reproduction system continues to produce acceptable images without downtime while awaiting service by personnel.

A system made in accordance with the principles of the present invention may also include a diagnostic subsystem for determining causes for the detected banding defect. The diagnostic subsystem determines one or more possible causes for a detected banding defect so that the compensation subsystem may adjust one or more system components. The system may also include a notification subsystem. The notification subsystem receives the identified causes for the banding defects from the diagnostic subsystem and generates a notification of the banding defect causes for delivery to the operator of the print engine and to the print engine service personnel. The notification may also include a corrective action that addresses the identified banding defect. If the notification indicates that operator intervention is required, the operator may conveniently schedule the service because the image reproduction system has adjusted its operation to provide acceptable images while awaiting service. If the notification indicates that service personnel are required, the service personnel may likewise be conveniently scheduled because the image reproduction system continues to provide acceptable images.

The component subsystems for the image reproduction system monitor the component subsystems of an image reproduction system made in accordance with the principles of the present invention. The image reproduction system includes a digital front end (DFE)/image input terminal (IIT) for preprocessing image data to generate an image. The image data preprocessing may include generation of the raster scan data that is used by the raster output scanner in the exposure subsystem to produce a latent image on a photoreceptor belt in the image reproduction system. Other image data preprocessing includes halftone data adjustments using a tonal reproduction curve (TRC) lookup table as well as other data manipulations, conversions, and adjustments. The charge subsystem of the image reproduction system charges a portion of the photoreceptor belt. The exposure subsystem generates a latent image on the photoreceptor belt charged by charging subsystem. The development subsystem applies toner to the latent image on the photoreceptor belt and the toner is transferred to a sheet medium by the transfer subsystem. The transferred toner is fused to the sheet medium by the fusing subsystem.

In one embodiment of the present invention, the detection subsystem monitors the photoreceptor following the charge subsystem and the exposure subsystem. This detection subsystem may be a device that generates voltage signals corresponding to electrostatic charges on the photoreceptor belt, such as an electrostatic voltmeter (ESV). The device may be coupled to a mechanical scanner so it measures electrostatic charges across the photoreceptor belt for the detection of cross-process banding defects. The charge level measurements for various positions on the photoreceptor belt and data regarding the voltages to which the photoreceptor belt has been exposed are used by the detection subsystem to detect charging errors that cause cross-process banding defects. The charging errors may be provided by the detection subsystem to the compensation system so that system component adjustments may occur for continuing the operation of the image reproduction system. Alternatively, the detection subsystem may provide the charging errors to the diagnostic subsystem for further analysis so that the causes of the charging errors may be determined.

In another embodiment of the present invention, the detection subsystem monitors the toner density on the photoreceptor following the development subsystem. This detection system may be a device for measuring the density of toner applied to the photoreceptor belt, such as an enhanced toner area coverage (ETAC) sensor or a full width array sensor (FWA). The voltage signals generated by these devices correspond to the density of the toner applied to various positions on the photoreceptor belt. These data signals and the data regarding the voltages used to apply toner to the photoreceptor belt are used by the detection subsystem to detect process direction banding defects caused by the development subsystem or one or more of the subsystems upstream to the development subsystem. An ETAC sensor may be coupled to a mechanical scanner to generate voltage signals that correspond to toner density. These signals may be used to detect cross-process banding defects. Identification data for the detected banding defects may be provided by the detection subsystem to the compensation system so that system component adjustments may occur for continuing the operation of the image reproduction system. Alternatively, the detection subsystem may provide the error identification data to the diagnostic subsystem for further analysis so that the causes of the identified errors may be determined.

In another embodiment of the present invention, the detection subsystem monitors the residual toner density on the photoreceptor following the transfer subsystem. This detection system may be a device for measuring the density of toner applied to the photoreceptor belt, such as an enhanced toner area coverage (ETAC) sensor or a full width array sensor (FWA). The voltage signals generated by these devices correspond to the density of the toner applied to various positions on the photoreceptor belt. These data signals and the data regarding the voltages used to transfer toner from the photoreceptor belt are used by the detection subsystem to detect process direction banding defects caused by the transfer subsystem. An ETAC sensor may be coupled to a mechanical scanner to generate voltage signals that correspond to toner density. These signals may be used to detect cross-process banding defects. Identification data for the detected banding defects may be provided by the detection subsystem to the compensation system so that system component adjustments may occur for continuing the operation of the image reproduction system. Alternatively, the detection subsystem may provide the error identification data to the diagnostic subsystem for further analysis so that the causes of the identified errors may be determined.

In another embodiment of the present invention, the detection subsystem monitors the toner on an intermediate belt to which toner of one or more color separations have been transferred. This detection system may be through a device for measuring the density of the toner applied to the intermediate belt, such as a FWA. The voltage signals generated by the FWA, for example, correspond to the density of the toner applied to the intermediate belt at various positions on the intermediate belt. These data and the data regarding the voltages used to transfer the toner from the photoreceptor belt to the transfer belt are used by the detection subsystem to detect banding defects caused by the transfer subsystem or one or more of the subsystems upstream to the transfer subsystem. Identification data for the detected banding defects may be provided by the detection subsystem to the compensation system so that system component adjustments may occur for continuing the operation of the image reproduction system. Alternatively, the detection subsystem may provide the error identification data to the diagnostic subsystem for further analysis so that the causes of the identified errors may be determined.

In another embodiment of the present invention, the detection subsystem monitors the toner on a sheet medium to which toner of one or more color separations have been transferred. The toners on the sheet medium have been transferred from a photoreceptor or an intermediate belt. The detection system may precede or follow the fusing system. The detection system may be a device for measuring the density of the toner applied to the sheet medium, such as a FWA. The voltage signals generated by the FWA, for example, correspond to the density of the toner applied to the intermediate belt at various positions on the sheet medium. These data and the data regarding the voltages used to transfer the toner from the photoreceptor belt to the sheet medium and/or from the intermediate belt to the sheet medium are used by the detection subsystem to detect banding defects caused by the transfer subsystem or one or more of the subsystems upstream to the transfer subsystem. Identification data for the detected banding defects are provided by the detection subsystem to the diagnostic subsystem so that the causes of the banding defects may be determined.

In another embodiment of the present invention, the detection subsystem monitors the toner on the sheet medium after it is processed by the fusing subsystem. Specifically, test images are provided by the detection subsystem to the DFE/IIT and the sheet medium on which the patterns are printed are scanned with a flat bed scanner or the like. The density data generated by the FWA of the scanner and the data regarding the test images are evaluated used by a scanned image analyzer of the detection subsystem to detect banding defects that may be caused by one or more of the subsystems in the image reproduction system. The identification data for the detected banding defects are provided by the detection subsystem to the diagnostic subsystem so that the causes of the banding defects may be determined.

In another embodiment of the present invention, a first detection subsystem monitors the photoreceptor following the charging subsystem and the exposure subsystem, a second detection subsystem monitors the photoreceptor following the development subsystem, a third detection subsystem monitors the photoreceptor following the transfer subsystem, a fourth detection system monitors the intermediate belt following the first transfer, a fifth detection system monitors the sheet medium following transfer to the sheet medium, and a sixth detection system monitors the sheet medium following the fusing subsystem. The six detection subsystems perform as noted previously. The inclusion of all six detection subsystems in a system made in accordance with the principles of the present invention enables the banding defects to be detected at multiple subsystems in the image reproduction system. The data from these detection subsystems may be provided to the compensation subsystem for adjustment of the image reproduction system components. Alternatively, these data may be provided to the diagnostic subsystem to determine whether the banding defects detected in the image produced at the fusing subsystem output are the culmination of multiple errors occurring at multiple subsystems in the image reproduction system.

In the systems having one or more detection subsystems described above, the error identification data may be provided to the diagnostic subsystem or to the compensation subsystem. The diagnostic subsystem determines one or more causes for the banding errors detected by a detection subsystem while the automated compensation subsystem adjusts the operation of the image reproduction system to compensate for the cause of the detected banding defects in at least three ways. In a system in which a single detection subsystem is provided, the automated compensation subsystem may include a local compensation subsystem to adjust the operation of one or more components in an image reproduction subsystem to which the detection subsystem is coupled. For example, the automated compensation subsystem may adjust the charging voltage generated by charging subsystem or the exposure voltage produced by the ROS in the exposure subsystem in response to identification of a banding defect by the detection subsystem coupled to one of those subsystems. The automated compensation subsystem may also adjust the operation of a subsystem that is upstream of the subsystem to which the detection system is coupled. For example, the automated compensation subsystem may include a global compensation subsystem to adjust voltages used by the development subsystem to compensate for banding errors detected by a detection subsystem coupled to a downstream subsystem. Operational adjustment of the subsystem to which the detection subsystem is coupled may occur in conjunction with the operational adjustment of one or more upstream subsystems.

One other way in which the automated compensation subsystem may compensate for errors causing detected banding defects is the use of an input data compensation subsystem to adjust the preprocessing of image data at the DFE/IIT. For example, the input data compensation subsystem may adjust a tonal reproduction curve by switching the tables used for mapping gray scale levels to halftone values. Use of the new look up table may be time dependent to compensate for banding defects in the cross-process direction or spatially dependent to compensate for banding defects in the process direction. Compensation action of this type may also be accompanied by operational adjustment of the print engine subsystem to which a detection subsystem is coupled or to an upstream image reproduction subsystem as discussed above.

A method for implementing the principles of the present invention detects a banding defect in an image reproduction system and compensates for the detected banding defect by modifying operation of the image reproduction system so that the image reproduction system continues to generate images at an acceptable quality level. The detection of a banding defect may include generating a voltage signal corresponding to an image generation parameter and detecting a banding defect corresponding to the generated voltage. The generated voltage signal may correspond to an electrostatic voltage on the photoreceptor belt or a toner density on the photoreceptor belt, the intermediate belt, or the sheet medium to which toner is transferred. The voltage signal corresponding to an electrostatic voltage may be generated by moving an electrostatic voltmeter (ESV) across the photoreceptor belt. The voltage signal corresponding to a toner density may be generated by an enhanced toner area coverage (ETAC) sensor or a full width array (FWA). The signal generated by the ETAC sensor in response to toner patches moving in the direction of the image generating process may be used to detect banding defects in the process direction. Signals generated by an ETAC sensor or ESV moving across the photoreceptor belt may be used to detect banding defects in the cross-process direction. Signals generated by the FWA may be used to detect banding defects in both the process and cross-process directions.

Detection of a banding defect may be performed by providing a test image to the DFE/IIT of an image reproduction system. After the test image is processed by the image reproduction system to produce the test image on sheet medium, the image generated on the sheet medium is scanned by a flatbed scanner or the like. The scanned image is subjected to a detailed image quality analysis to detect banding defects present in the scanned image. The causes for the detected banding defects are determined and the operation of the print engine is modified to compensate for the detected banding defect.

The method may also include identifying a cause for the detected banding defects. The identified cause may be used for the modification of the image reproduction system for continued operation. The method may also include notifying personnel of corrective actions addressing the detected banding defects that are required for continued operation of the image reproduction system.

The above described features and advantages, as well as others, will become more readily apparent to those of ordinary skill in the art by reference to the following detailed description and accompanying drawings.

DETAILED DESCRIPTION

Figure 1:
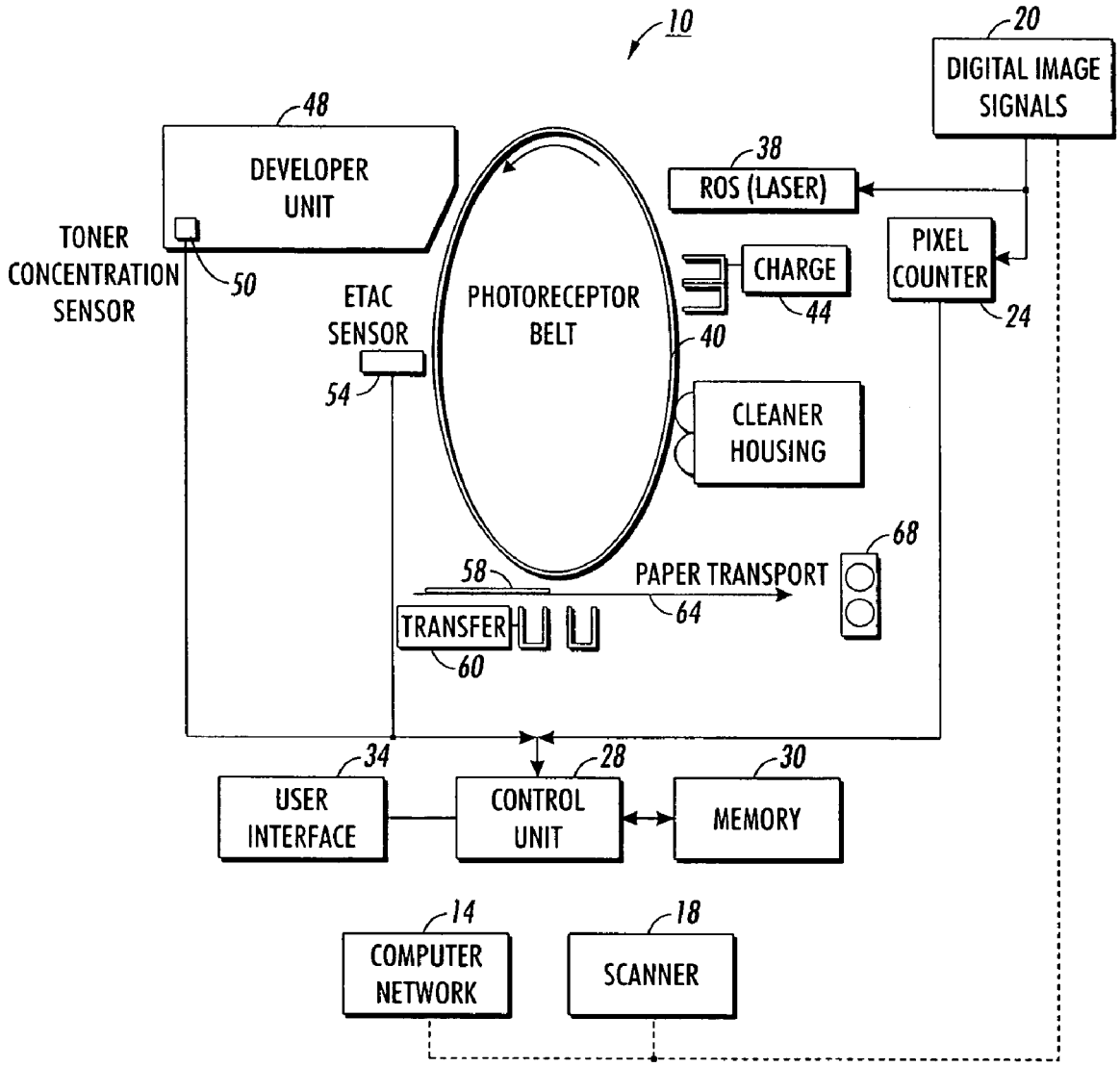
FIG. 1 shows a block diagram of a digital document reproduction system in which a system and method implementing the detection and compensation principles of the present invention may be used.

FIG. 1 shows a digital document reproduction system in which the calibration of the present invention may be used. The system 10 may include a computer network 14 through which digital documents are received from computers, scanners, and other digital document generators. Also, digital document generators, such as scanner 18, may be coupled to the digital image receiver 20. The data of the digital document images are provided to a pixel counter 24 that is also coupled to a controller 28 having a memory 30 and a user interface 34. The digital document image data is also used to drive the raster output scanner 38. The photoreceptor belt 40 rotates in the direction shown in FIG. 1 for the development of the latent image and the transfer of toner from the latent image to the support material. The system shown in FIG. 1 may also include an intermediate belt for the transfer of toners from the photoreceptor to the sheet medium. A system of the present invention, discussed in more detail below, may be used with a print engine with or without an intermediate belt.

To generate a hard copy of a digital document, the photoreceptor belt is charged using corona discharger 44 and then exposed to the ROS 38 to form a latent image on the photoreceptor belt 40. Toner is applied to the latent image from developer unit 48. Signals from toner concentration sensor 50 and ETAC sensor 54 are used by the controller 28 to determine the DMA for images being developed by the system 10. The toner applied to the latent image is transferred to a sheet of support material 58 at transfer station 60 by electrically charging the backside of the sheet 58. The sheet is moved by paper transport 64 to fuser 68 so that the toner is permanently affixed to the sheet 58.

Figure 2:
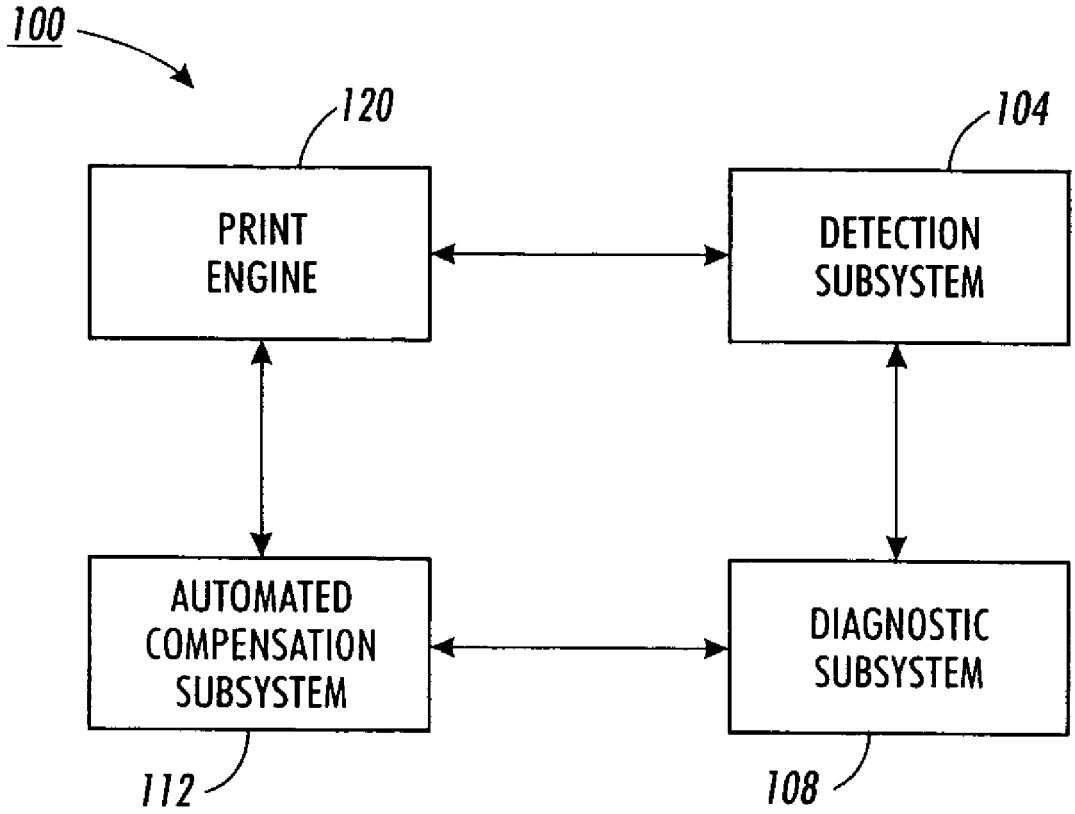
FIG. 2 is a block diagram depicting subsystem components of a system implementing the principles of the present invention.

A system implementing the principles of the present invention is shown in FIG. 2. The system 100 includes a detection subsystem 104, a diagnostic subsystem 108, and an automated compensation subsystem 112, although the system may be comprised of the detection subsystem 104 and the automated compensation subsystem 112 as described below. Detection subsystem 104 is coupled to an image reproduction system, such as a print engine 120, to obtain data from the print engine about one or more banding defects in the images generated by the print engine 120. Identification data for the banding defects detected by the detection subsystem 104 may be provided to the automated compensation system 112 so the automated compensation subsystem 112 adjusts components and/or data used by the print engine 120 to compensate for the identified banding defect without requiring intervention by an operator or service personnel. This compensation may successfully attenuate the banding defect so that the print engine 120 of an image reproduction system continues to produce acceptable images without downtime while awaiting service by personnel. In the embodiment shown in FIG. 2, the error identification data are provided to the diagnostic subsystem 108 and the diagnostic subsystem 108 analyzes the identified banding defect to determine the probable causes of the identified banding defect. The identified causes are provided to the automated compensation subsystem 112 for adjustment of the print engine operation as discussed above.

The system 100 may also include a notification subsystem 118. The notification subsystem 118 receives the identified causes for the banding defects from the diagnostic subsystem 108 and generates a notification of the banding defect causes for delivery to the operator of the print engine and to the print engine service personnel. The notification may also include corrective action addressing the detected banding defect. If the notification indicates that operator intervention is required, the operator may conveniently schedule the service because the image reproduction system is producing acceptable images. If the notification indicates that service personnel are required, the service personnel may likewise be conveniently scheduled without loss of image production by the print engine 120.

Figure 3:
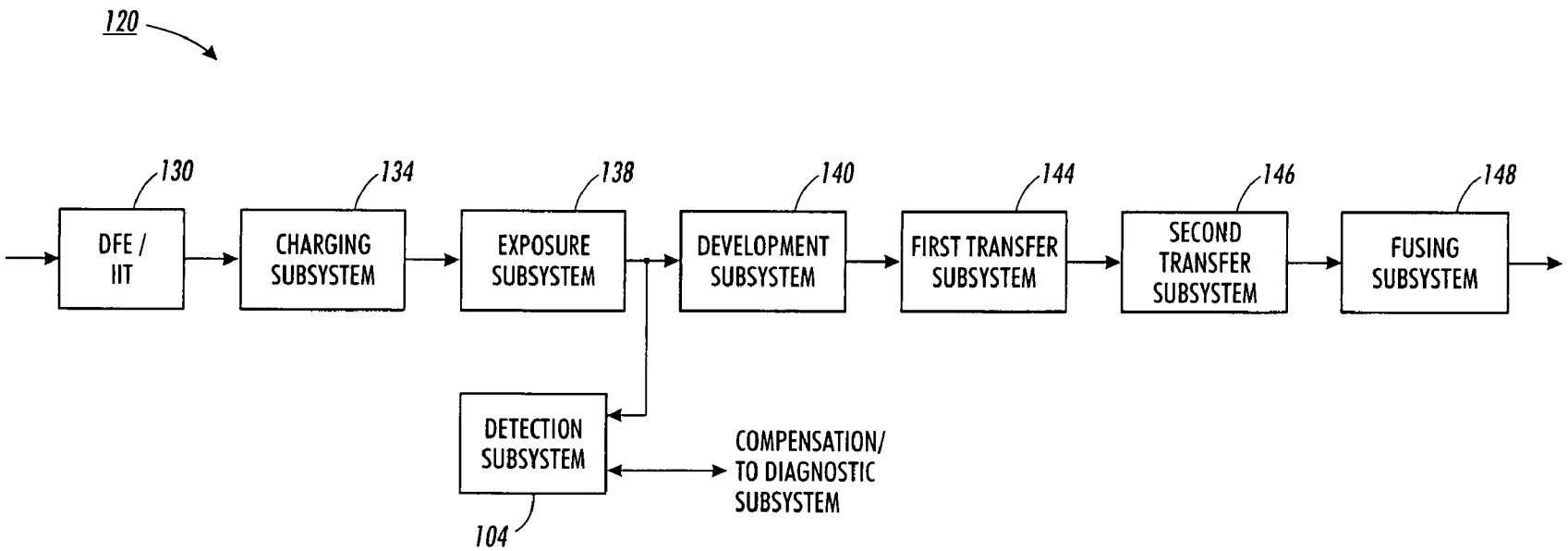
FIG. 3 is a block diagram of an embodiment of the present invention in which the detection system monitors the electrostatic image following the charging subsystem and the exposure subsystem of the print engine shown in FIG. 2.

One relationship of the component subsystems for print engine 120 with the component subsystems of system 100 are shown in FIG. 3. The print engine 120 includes a digital front end (DFE)/image input terminal (IIT) 130 for preprocessing image data to generate an image. The image data preprocessing may include generation of the raster scan data that is used by the raster output scanner in the exposure subsystem 138 to produce a latent image on a photoreceptor belt in the print engine 120. Other image data preprocessing includes halftone data adjustments using a tonal reproduction curve (TRC) lookup table as well as other data manipulations, conversions, and adjustments. The charge subsystem 134 of the print engine 120 charges a portion of the photoreceptor belt. The exposure subsystem 138 generates a latent image on the photoreceptor belt charged by the subsystem 134. The development subsystem 140 applies toner to the latent image on the photoreceptor belt and the toner is transferred to between the first transfer subsystem 144 and the second transfer subsystem 146 and then to a medium sheet by the second transfer subsystem 146. The transferred toner is fused to the medium sheet by the fusing subsystem 148.

In one embodiment of the present invention depicted in FIG. 3, the detection subsystem 104 monitors the electrostatic image following the charge subsystem 134 and to the exposure subsystem 138. This coupling may be through a device that generates a voltage signal that corresponds to electrostatic charge on the photoreceptor belt, such as an electrostatic voltmeter (ESV). The device may be attached to a mechanical scanner that moves the device across the photoreceptor belt. The charge level measurements for various positions on the photoreceptor belt and data regarding the voltages to which the photoreceptor belt has been exposed are used by the detection subsystem 104 to detect charging errors that cause cross-process banding defects. The identified charging errors may be provided by the detection subsystem 104 to the compensation subsystem 112 or to the diagnostic subsystem 108 so that the causes of the charging errors may be determined.

Figure 4:
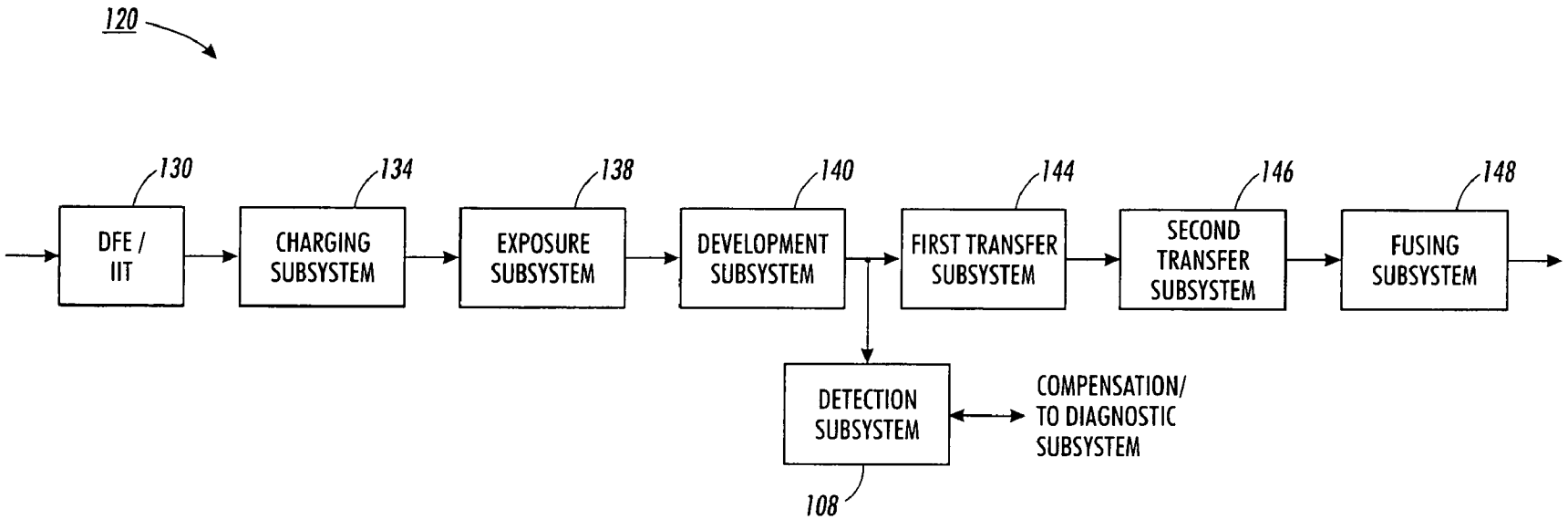
FIG. 4 is a block diagram of an embodiment of the present invention in which the detection system monitors the toner density following the development subsystem of the print engine shown in FIG. 2.

In another embodiment of the present invention depicted in FIG. 4, the detection subsystem 104 monitors the toner density following the development subsystem 140. The toner density may be monitored by a device for measuring the density of toner applied to the photoreceptor belt, such as an enhanced toner area coverage (ETAC) sensor or a full width array sensor (FWA). The voltage signals generated by these devices correspond to the density of the toner applied to various positions on the photoreceptor belt. These data signals and the data regarding the voltages used to apply toner to the photoreceptor belt are used by the detection subsystem 104 to detect process direction banding defects caused by one or more of the subsystems 134, 138, or 140. For example, the voltage signals from an ETAC sensor may be subjected to frequency analysis to identify a banding defect. Another ETAC sensor may be attached to a mechanical scanner to provide data regarding cross-process banding defects. Identification data for the banding defects may be provided by the detection subsystem 104 to the compensation subsystem 112 for adjusting the print engine operation or to the diagnostic subsystem 108 so that the causes of the banding defects may be determined.

Figure 5:
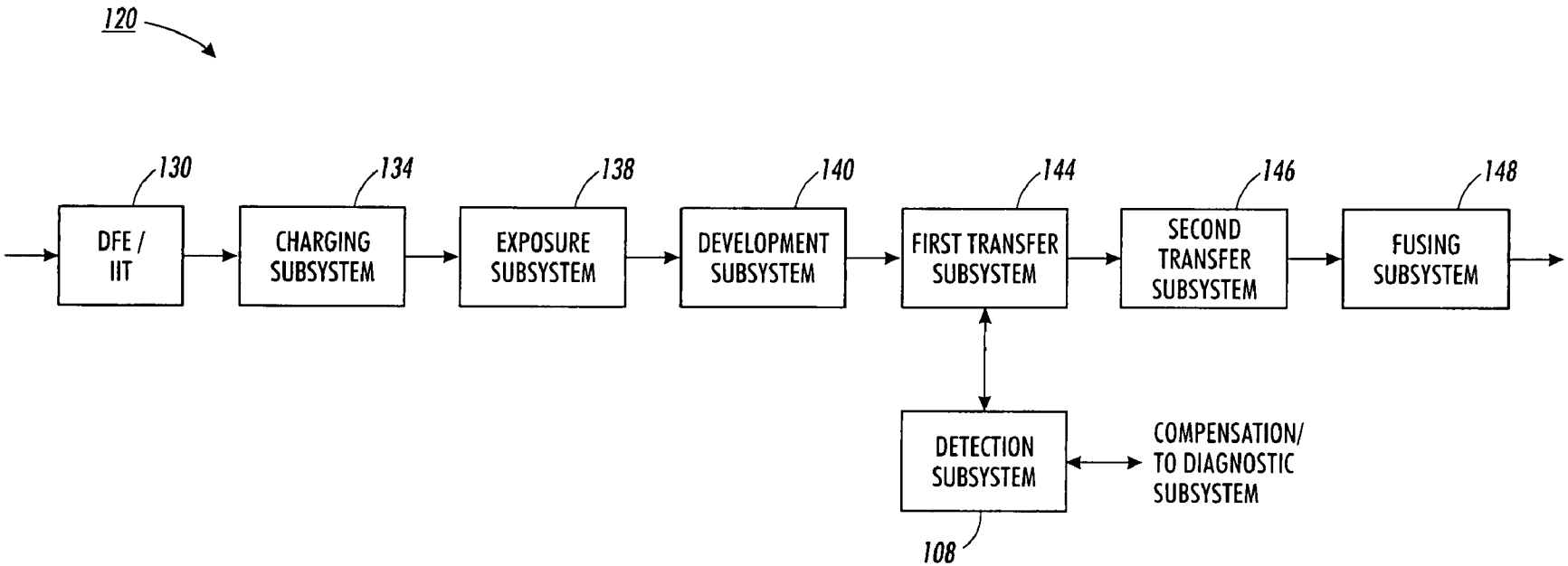
FIG. 5 is a block diagram of an embodiment of the present invention in which the detection system monitors the residual toner density of the first transfer subsystem of the print engine shown in FIG. 2.

In another embodiment of the present invention depicted in FIG. 5, the detection subsystem 104 monitors the residual toner on the photoreceptor performed by the first transfer subsystem 144. This coupling may be through a device for measuring the density of the toner applied to the sheet medium, such as a FWA. The voltage signals generated by the FWA, for example, correspond to the density of the toner applied to the sheet medium at various positions on the sheet medium. These data and the data regarding the voltages used to transfer the toner from the photoreceptor belt to the sheet medium are used by the detection subsystem 104 to detect banding defects caused by one or more of the subsystems 134, 138, 140, or 144. Identification data for the banding defects may be provided by the detection subsystem 104 to the compensation subsystem 112 for adjusting the print engine operation or to the diagnostic subsystem 108 so that the causes of the banding defects may be determined.

Figure 6:
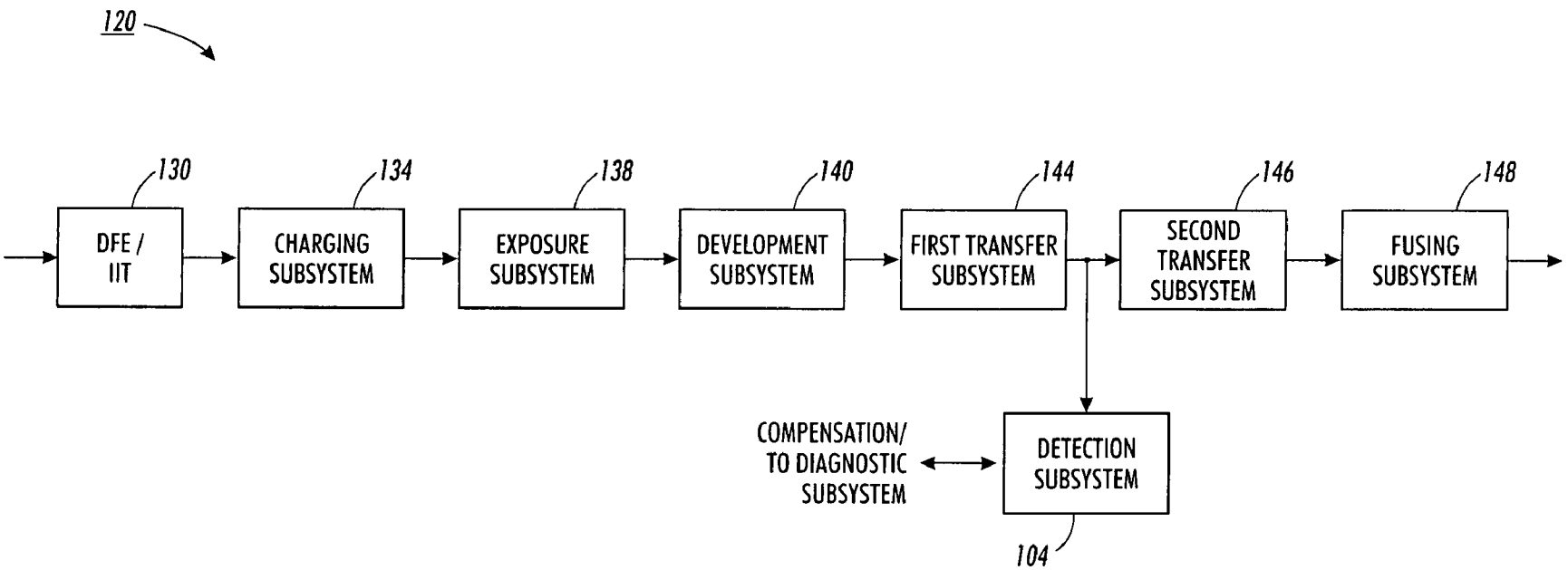
FIG. 6 is a block diagram of an embodiment of the present invention in which the detection system monitors the toner density following the first transfer on the intermediate belt of the print engine shown in FIG. 2.

In another embodiment of the present invention depicted in FIG. 6, the detection subsystem 104 monitors the toner density on the intermediate belt following the first transfer subsystem 144. The toner density may be monitored by a device for measuring the density of toner applied to the photoreceptor belt, such as an enhanced toner area coverage (ETAC) sensor or a full width array sensor (FWA). The voltage signals generated by these devices correspond to the density of the toner applied to various positions on the photoreceptor belt. These data signals and the data regarding the voltages used to apply toner to the photoreceptor belt are used by the detection subsystem 104 to detect process direction banding defects caused by one or more of the subsystems 134, 138, or 140. For example, the voltage signals from an ETAC sensor may be subjected to frequency analysis to identify a banding defect. Another ETAC sensor may be attached to a mechanical scanner to provide data regarding cross-process banding defects. Identification data for the banding defects may be provided by the detection subsystem 104 to the compensation subsystem 112 for adjusting the print engine operation or to the diagnostic subsystem 108 so that the causes of the banding defects may be determined.

Figure 7:
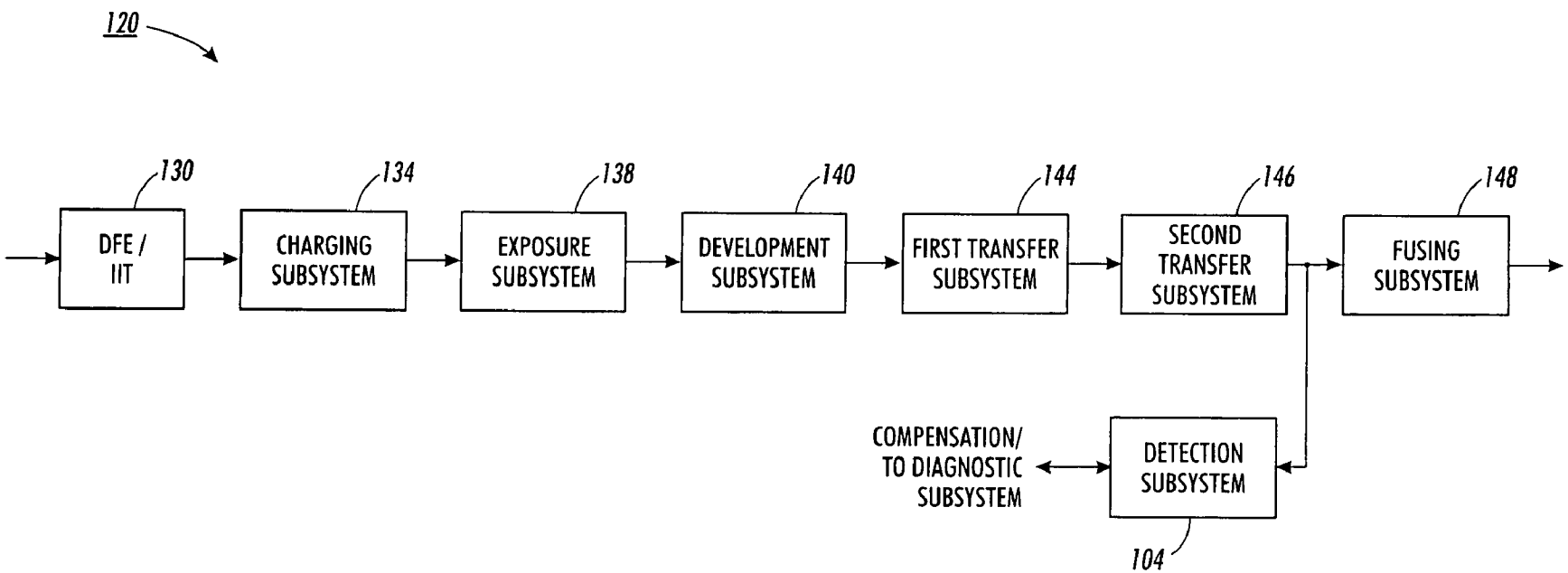
FIG. 7 is a block diagram of an embodiment of the present invention in which the detection system monitors the toner density following the second transfer on the intermediate belt of the print engine shown in FIG. 2.

In another embodiment of the present invention depicted in FIG. 7, the detection subsystem 104 monitors the toner density on the sheet media preceding the fusing subsystem 148. The toner density may be monitored by a device for measuring the density of the toner applied to the photoreceptor belt, such as an ETAC sensor or a FWA. The voltage signals generated by the FWA, for example, correspond to the density of the toner applied to the photoreceptor belt. These data are used by the detection subsystem 104 to detect banding defects caused by one or more of the subsystems 134, 138, 140, or 144. Identification data for the banding defects may be provided by the detection subsystem 104 to the compensation subsystem 112 for adjusting the print engine operation or to the diagnostic subsystem 108 so that the causes of the banding defects may be determined.

Figure 8:
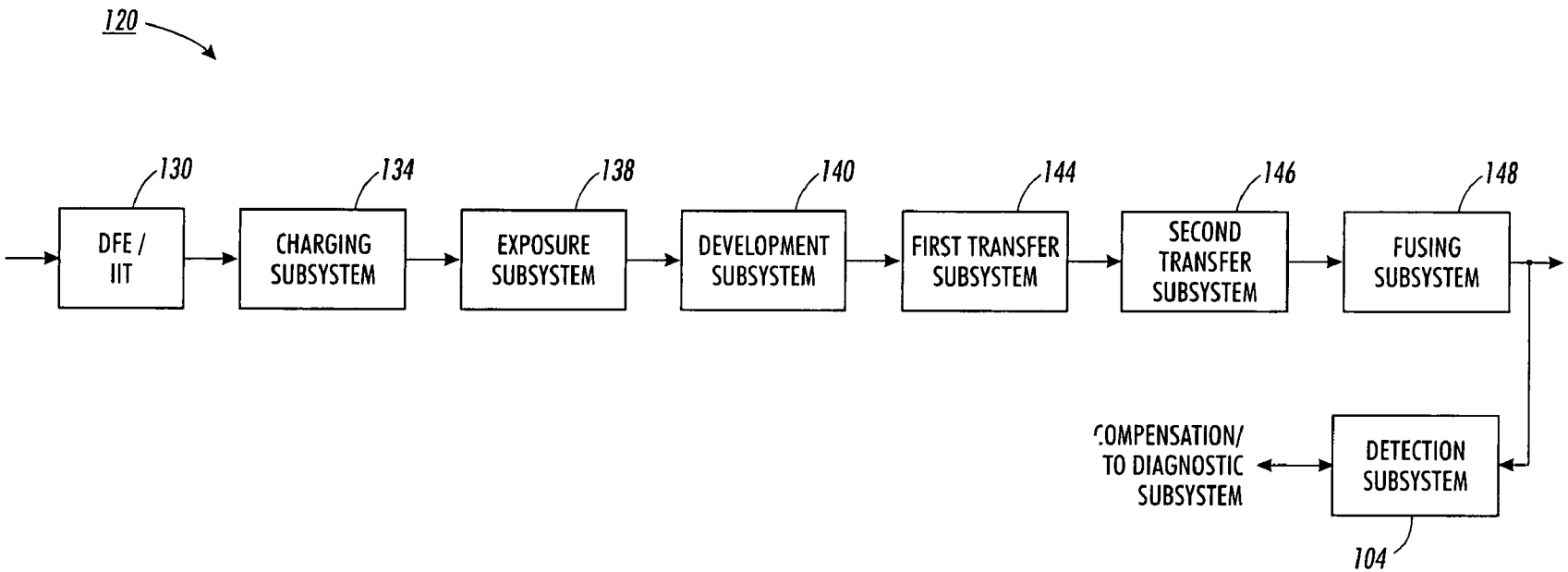
FIG. 8 is a block diagram of an embodiment of the present invention in which the detection system monitors the toner density following the fusing subsystem of the print engine shown in FIG. 2.

In another embodiment of the present invention depicted in FIG. 8, the detection subsystem 104 monitors the toner on the sheet media following the fusing subsystem 148 through the output at the fusing subsystem. Specifically, test images are provided by the detection subsystem to the DFE/IIT 130 and the sheet medium on which the test images are printed are scanned with a flat bed scanner or the like. The density data generated by the FWA of the scanner and the data regarding the test images are evaluated by a scanned image analyzer of the detection subsystem 104 to detect banding defects that may be caused by one or more of the subsystems in the print engine 120. The banding defects may be provided by the detection subsystem 104 to the compensation subsystem 112 for adjusting the print engine operation or to the diagnostic subsystem 108 so that the causes of the banding defects may be determined.

Figure 9:
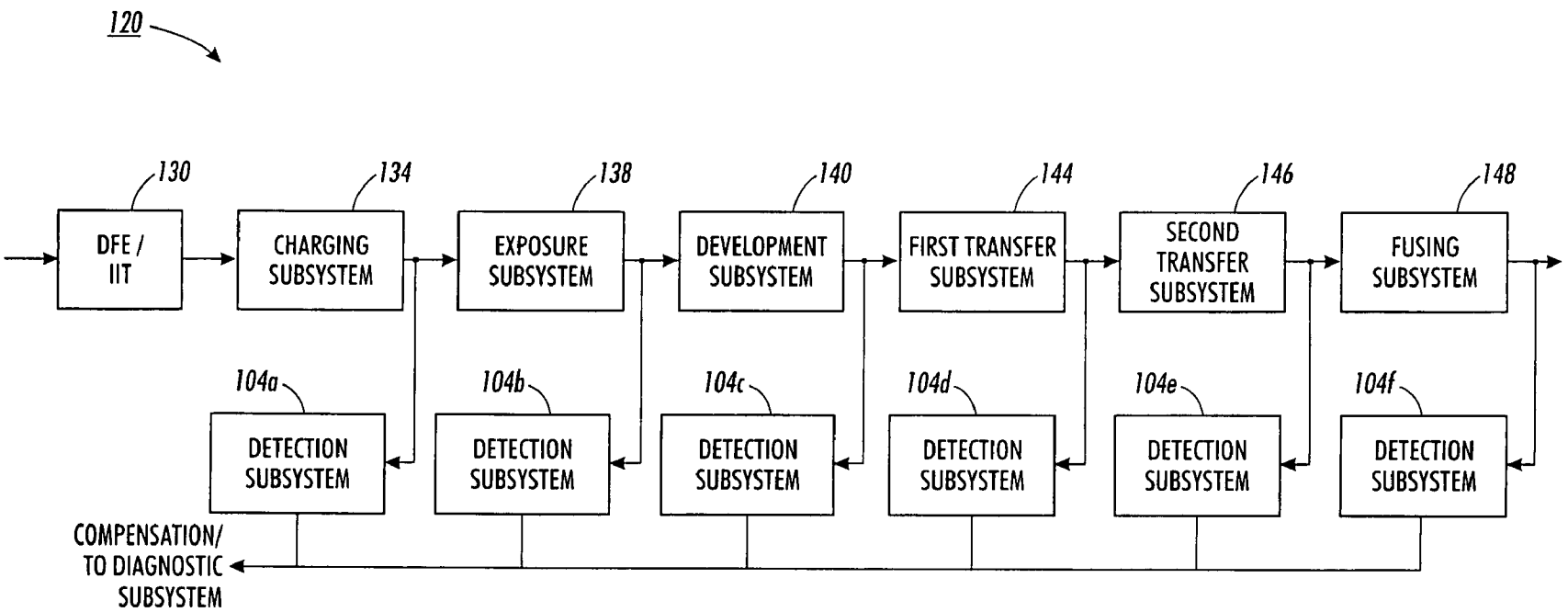
FIG. 9 is a block diagram of an embodiment of the present invention in which six detection subsystems monitor the electrostatic image as it is processed by the subsystems of the print engine shown in FIG. 2.

In another embodiment of the present invention depicted in FIG. 9, the detection subsystems 104*a*, 104*b*, 104*c*, 104*d*, 104*e*, and 104*f* monitor the electrostatic image and toner density as the image is processed by the charging subsystem 134, the exposure subsystem 138, the development subsystem 140, the first and the second transfer subsystems 144, 146 and the fusing subsystem 148. The detection subsystems 104*a*, 104*b*, 104*c*, 104*d*, 104*e*, and 104*f*, perform as noted previously. The inclusion of all six detection subsystems in the system 100 enables the banding defects to be detected at multiple subsystems in the print engine 120. The data from these detection subsystems may be used by the compensation subsystem 112 to adjust the operation of the print engine or to enable the diagnostic subsystem 108 to determine whether banding defects detected in the image produced at the fusing subsystem output are the culmination of multiple errors occurring at multiple subsystems in the print engine 120.

Figure 10:
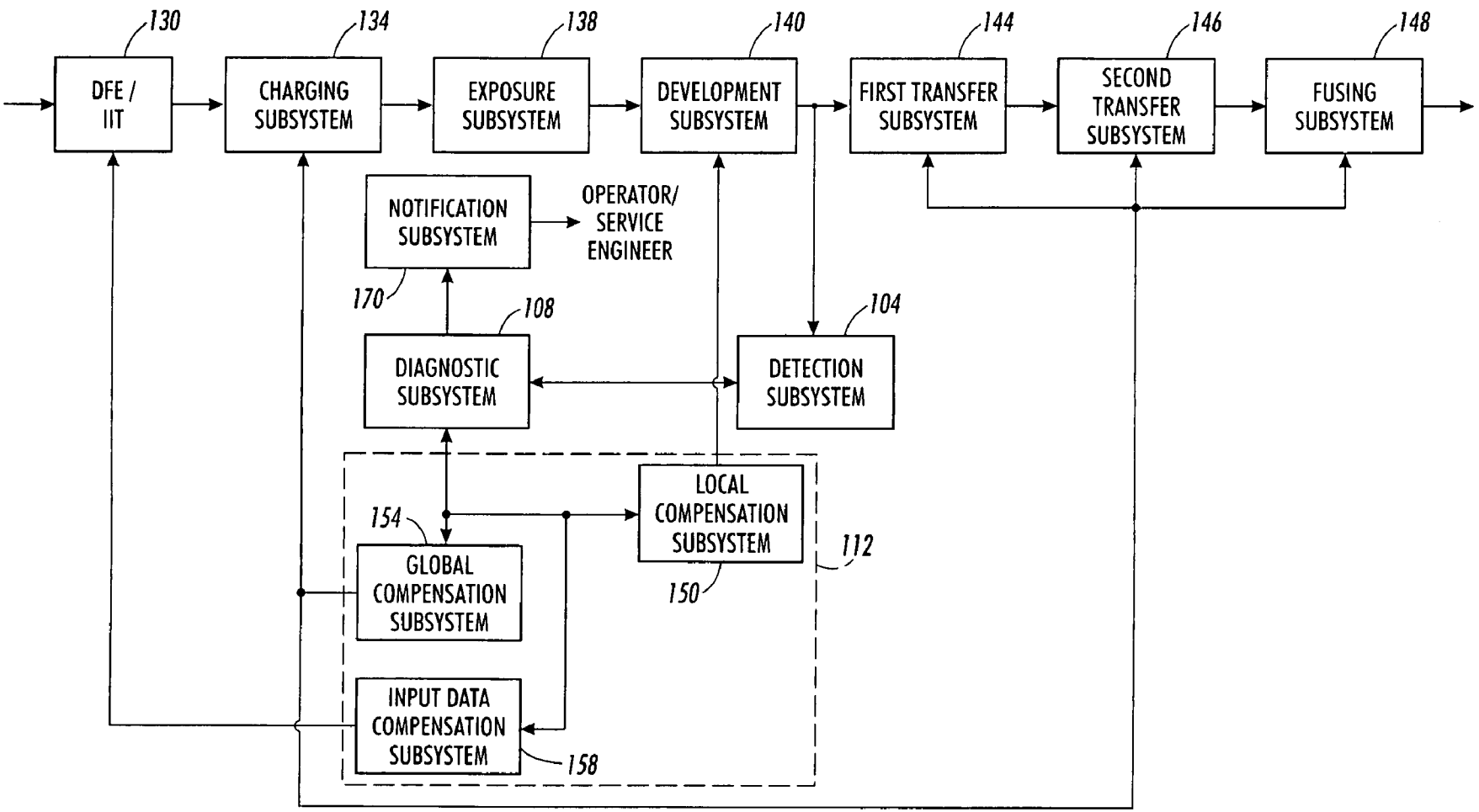
FIG. 10 is a block diagram of the embodiment shown in FIG. 4 depicting the coupling of the local compensation subsystem, the global compensation subsystem, and the input data compensation subsystem to the components of the print engine.

In the systems having one or more detection subsystems described above and the diagnostic subsystem 108, the diagnostic subsystem 108 determines one or more causes for the banding errors detected by a detection subsystem. The identification data for the cause or causes are provided to the automated compensation subsystem 112. These data may also be provided to notification subsystem 170 (FIG. 10, for example) for reporting error causes to a system operator or a service engineer. The automated compensation subsystem 112 may adjust the operation of the print engine 120 to compensate for the cause of the detected banding defects in at least three ways. In a system in which a single detection subsystem is provided, the automated compensation subsystem 112 may adjust the operation of one or more components in the print engine subsystem to which the detection subsystem is coupled. For example, as shown in FIG. 10, the automated compensation subsystem 112 may include a local compensation subsystem 150 to adjust a development voltage generated by the development subsystem 140 in response to a banding defect detected by the detection subsystem coupled to the print engine. The automated compensation subsystem 112 may also adjust the operation of a subsystem that is upstream of the subsystem to which the detection system is coupled. For example, as shown in FIG. 10, the automated compensation subsystem 112 may include a global compensation subsystem 154 to adjust voltages used by the first and the second transfer subsystems 144, 146 to compensate for banding errors detected at the development subsystem 140 by the detection system coupled to the print engine. Operational adjustment of the subsystem to which the detection subsystem is coupled may occur in conjunction with the operational adjustment of upstream subsystems.

One other way in which the automated compensation subsystem 112 may compensate for errors causing detected banding defects is the use of an input data compensation subsystem 158 to adjust the preprocessing of image data at the DFE/IIT 130. For example, the input data compensation subsystem 158 may adjust a tonal reproduction curve by switching the tables used by DFE/IIT 130 for mapping gray scale levels to halftone values. Use of the new look up table may be time dependent to compensate for banding defects in the cross-process direction or spatially dependent to compensate for banding defects in the process direction. Compensation action of this type may also be accompanied by operational adjustment of the print engine subsystem to which a detection subsystem is coupled or to an upstream print engine subsystem as discussed above.

The detection subsystems described above may be implemented as computer programs stored in memory for one or more processors that are coupled by appropriate interfaces to the print engine subsystems. In systems having multiple detection subsystems coupled to the print engine subsystems, the detection subsystems may be implemented with separate processors and programs or they may implemented with modules or as part of a single program executed by a single processor. The diagnostic subsystem 108 and the automated compensation subsystem 112 may also be implemented with one or more separate processors or they may also be implemented with modules or as part of a single program executed by a single processor. The notification subsystem 116 may be implemented in similar ways within the system 100.

Figure 11:
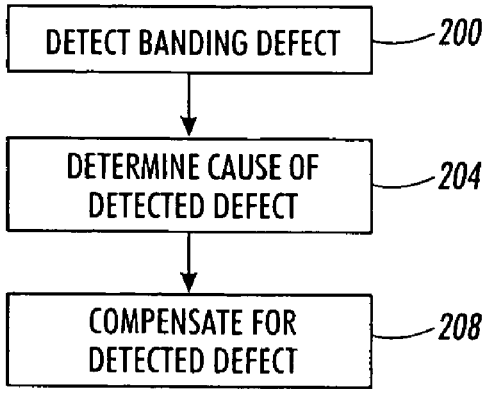
FIG. 11 is a flowchart of a process operating in accordance with the principles of the present invention.
Figure 12:
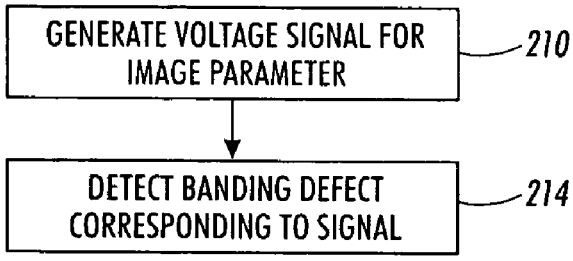
FIG. 12 is a flowchart showing more detail of the banding defect detection depicted in FIG. 11.

The method implemented by the system 100 may be described as shown in FIG. 11. The method detects a banding defect in an image reproduction system (block 200), determines the cause of the detected banding defect (block 204), and compensates for the detected banding defect by modifying operation of the image reproduction system (block 208). This process may be performed without the banding defect cause determination. In such a method, the compensation is performed to adjust for the identified detecting error. The detection of a banding defect may include the process of FIG. 12. In that process, a voltage signal corresponding to an image generation parameter is generated (block 210) and a banding defect corresponding to the generated voltage is detected (block 214). The generated voltage signal may correspond to an electrostatic voltage on the photoreceptor belt or a toner density either on the photoreceptor belt or the sheet medium to which toner is transferred. The voltage signal corresponding to an electrostatic voltage may be generated by moving an electrostatic voltmeter (ESV) across the photoreceptor belt. The voltage signal corresponding to a toner density may be generated by an enhanced toner area coverage (ETAC) sensor or a full width array (FWA). The signal generated by the ETAC sensor in response to toner patches moving in the direction of the image generating process may be used to detect banding defects in the process direction. Signals generated by an ETAC sensor or ESV moving across the photoreceptor belt may be used to detect banding defects in the cross-process direction. Signals generated by the FWA may be used to detect banding defects in both the process and cross-process directions.

Figure 13:
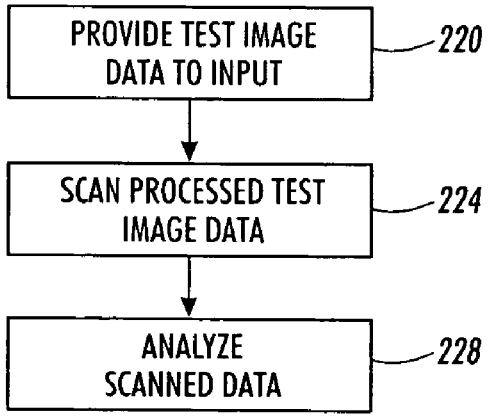
FIG. 13 is a flowchart showing more detail of the banding defect detection depicted in FIG. 11.

Detection of a banding defect may be performed by the process shown in FIG. 13, either alone or as a supplement to the process shown in FIG. 11. In that process, test image data are provided to DFE/IIT 130 (block 220). After the test image is processed by the print engine and printed on sheet medium, the image generated on the sheet medium is scanned by a flatbed scanner or the like (block 224). The scanned image is subjected to a detailed image quality analysis (block 228) to detect banding defects present in the image (block 234). Detailed image quality analysis is described in the co-pending patent application entitled Systems and Methods for Compensating for Streaks in Images, Ser. No. 10/701,475, which is commonly assigned to the assignee of this patent, the disclosure of which is expressly incorporated herein by reference in its entirety. The causes for the detected banding defects are determined (block 238) and the operation of the print engine is modified to compensate for the detected banding defect.

While the present invention has been illustrated by the description of exemplary processes and system components, and while the various processes and components have been described in considerable detail, applicant does not intend to restrict or in any limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for adjusting operation of an image reproduction system to compensate for banding defects comprising:

a detection subsystem coupled to one of a charging subsystem, an exposure subsystem, a development subsystem, a transfer subsystem, and a fusing subsystem of an image reproduction system for monitoring the coupled subsystem for detection of a banding defect;

an automated compensation subsystem having an input data compensation subsystem coupled to a digital front end/image input terminal (DFE/IIT) of the image reproduction system to modify preprocessing of image data performed by the DFE/IIT to compensate for a detected banding defect, the automated compensation subsystem also being configured for modifying operation of the image reproduction system by adjusting one or more subsystems other than the subsystem being monitored by the detection subsystem to compensate for the detected banding defect so that the image reproduction system continues to generate images at an acceptable quality level; and a diagnostic subsystem coupled to the detection subsystem to receive error identification data from the detection subsystem, the diagnostic subsystem being configured to identify a subsystem causing the detected banding error corresponding to the error identification data; and the automated compensation subsystem further comprising a local compensation subsystem that is coupled to the diagnostic subsystem, the local compensation subsystem being configured to modify operation of the subsystem identified by the diagnostic subsystem as being a cause of the detected banding defect.

2. The system of claim 1, the detection subsystem being coupled to the exposure subsystem for monitoring an electrostatic image on a photoreceptor belt following the charging subsystem and the exposure subsystem of the image reproduction system and further comprising:

an electrostatic voltmeter (ESV) attached to a mechanical scanner that moves across the photoreceptor belt, the ESV generating a voltage signal corresponding to electrostatic charge on the photoreceptor belt;

the detection subsystem using the voltage signal generated by the ESV to detect charging errors in a cross-process direction on the photoreceptor belt that indicate a banding defect has occurred in the electrostatic image on the photoreceptor belt; and the automated compensation subsystem being configured to adjust the charging subsystem and the DFE/IIT in response to a banding defect being detected by the detection subsystem.

3. The system of claim 1, the detection subsystem being coupled to the development subsystem for monitoring toner density in a developed electrostatic image on a photoreceptor belt following the development subsystem of the image reproduction system and further comprising:

an enhanced toner area coverage (ETAC) sensor for generating a voltage signal corresponding to toner density on a photoreceptor belt and the detection subsystem using the voltage signal generated by the ETAC sensor for detecting process direction banding defects on the photoreceptor belt; and the automated compensation subsystem being configured to adjust the charging subsystem, the exposure subsystem, and the DFE/IIT in response to a banding defect being detected by the detection subsystem.

4. The system of claim 1, the detection subsystem being coupled to the development subsystem for monitoring toner density in a developed electrostatic image on a photoreceptor belt following the development subsystem of the image reproduction system and further comprising:

an ETAC sensor attached to a mechanical scanner that moves across the photoreceptor belt to detect cross-process direction banding defects on the photoreceptor belt;

the detection subsystem using the voltage signal generated by the ETAC to detect charging errors in a cross-process direction on the photoreceptor belt that indicate a banding defect has occurred in the developed latent image on the photoreceptor belt; and the automated compensation subsystem being configured to adjust the charging subsystem, the exposure subsystem, and the DFE/IIT in response to a banding defect being detected by the detection subsystem.

5. The system of claim 1, the detection subsystem being coupled to the development subsystem for monitoring toner density in a developed electrostatic image on a photoreceptor belt following the development subsystem of the image reproduction system and further comprising:

a full width array (FWA) sensor to measure image quality metrics for detecting process direction banding defects in electrostatic images on the photoreceptor belt; and the automated compensation subsystem being configured to adjust the charging subsystem, the exposure subsystem, and the DFE/IIT in response to a banding defect being detected by the detection subsystem.

6. The system of claim 1, the detection subsystem being coupled to the transfer subsystem for monitoring residual toner density on a photoreceptor belt following the transfer subsystem of the image reproduction system and further comprising:

a full width array (FWA) sensor to measure image quality metrics for detecting process direction banding defects on the photoreceptor belt; and the automated compensation subsystem being configured to adjust the charging subsystem, the exposure subsystem, the development subsystem, and the DFE/IIT in response to a banding defect being detected by the detection subsystem.

7. The system of claim 1, the detection subsystem being coupled to the transfer subsystem for monitoring toner density on an intermediate belt following the transfer subsystem of the image reproduction system and further comprising:

a FWA sensor to measure image quality metrics for detecting process direction banding defects on the intermediate belt; and the automated compensation subsystem configured to adjust the charging subsystem, the exposure subsystem, the development subsystem, and the DFE/IIT in response to a banding defect being detected by the detection subsystem.

8. The system of claim 1, the detection subsystem being coupled to the fusing subsystem for monitoring toner density on a sheet medium in proximity to the fusing subsystem of the image reproduction system and further comprising:

a scanner for generating scanned images of test patterns;

a scanned image analyzer for detecting handing defects in the scanned images of the test patterns; and the automated compensation subsystem being configured to adjust the charging subsystem, the exposure subsystem, the development subsystem, the transfer subsystem, and the DFE/IIT in response to a banding defect being detected by the detection subsystem.

9. The system of claim 1, the automated compensation subsystem further comprising:

a global compensation subsystem for modifying operation of a subsystem not identified by the diagnostic subsystem as being a cause of a detected banding defect.

10. The system of claim 1 further comprising:

a notification subsystem for notifying personnel of corrective action for addressing the detected banding defects.

11. A method for adjusting operation of an image reproduction system to compensate for banding defects comprising:

monitoring one of a charging subsystem, an exposure subsystem, a development subsystem, a transfer subsystem, and a fusing subsystem in an image reproduction system;

detecting a banding defect at the image reproduction system subsystem being monitored;

compensating for the detected banding defect by adjusting preprocessing of image data performed by a digital front end/image input terminal (DFE/IIT) and by adjusting one of the charging subsystem, the exposure subsystem, the development subsystem, the transfer subsystem, the fusing subsystem not being monitored so that the image reproduction system continues to generate images at an acceptable quality level;

generating error identification data corresponding to the detected banding defect;

identifying with reference to the error identification data a subsystem causing the detected banding defect;

modifying operation of the identified subsystem.

12. The method of claim 11, the banding defect detection comprising:

generating a voltage signal corresponding to an image generation parameter; and detecting a banding defect that corresponds to the generated voltage signal.

13. The method of claim 12, the voltage signal generation comprising:

generating a voltage signal that corresponds to toner density on a photoreceptor belt; and detecting a cross-process direction banding defect that corresponds to the generated voltage signal.

14. The method of claim 13, the voltage signal generation comprising:

moving an enhanced toner area coverage (ETAC) sensor across the photoreceptor belt to generate a voltage signal corresponding to toner density on the photoreceptor belt; and detecting cross-process direction banding defects on the photoreceptor belt that correspond to the voltage signal generated by the ETAC.

15. The method of claim 12, the voltage signal generation comprising:

moving an electrostatic voltmeter (ESV) across a photoreceptor belt to generate a voltage signal corresponding to electrostatic charge on a photoreceptor belt; and detecting cross-process direction banding defects that correspond to the voltage signal generated by the ESV.

16. The method of claim 11, the DFE/IIT adjustment further comprising:

adjusting a tonal reproduction curve used by the DFE/IIT; and the method further comprising:

adjusting at least one of the charging subsystem, the exposure subsystem, the development subsystem, the transfer subsystem, and the fusing subsystem.

17. A system for adjusting operation of an image reproduction system to compensate for banding defects comprising:

a detection subsystem coupled to one of a charging subsystem, an exposure subsystem, a development subsystem, a transfer subsystem, and a fusing subsystem of an image reproduction system for monitoring the coupled subsystem for detection of a banding defect;

an automated compensation subsystem having an input data compensation subsystem coupled to a digital front end/image input terminal (DFE/IIT) of the image reproduction system to modify preprocessing of image data performed by the DFE/IIT to compensate for a detected banding defect, the automated compensation subsystem also being configured for modifying operation of the image reproduction system by adjusting one or more subsystems other than the subsystem being monitored by the detection subsystem to compensate for the detected banding defect so that the image reproduction system continues to generate images at an acceptable quality level;

a diagnostic subsystem coupled to the detection subsystem to receive error identification data from the detection subsystem, the diagnostic subsystem being configured to identify a subsystem causing the detected banding error corresponding to the error identification data;

a local compensation subsystem that is coupled to the diagnostic subsystem, the local compensation subsystem being configured to modify operation of the subsystem identified by the diagnostic subsystem as being a cause of the detected banding defect; and a notification subsystem for notifying personnel of corrective action for addressing the detected banding defects.

18. The system of claim 17, the detection subsystem being coupled to the exposure subsystem for monitoring an electrostatic image on a photoreceptor belt following the charging subsystem and the exposure subsystem of the image reproduction system and further comprising:

an electrostatic voltmeter (ESV) attached to a mechanical scanner that moves across the photoreceptor belt, the ESV generating a voltage signal corresponding to electrostatic charge on the photoreceptor belt;

the detection subsystem using the voltage signal generated by the ESV to detect charging errors in a cross-process direction on the photoreceptor belt that indicate a banding defect has occurred in the electrostatic image on the photoreceptor belt; and the automated compensation subsystem being configured to adjust the charging subsystem and the DFE/IIT in response to a banding defect being detected by the detection subsystem.

19. The system of claim 17, the detection subsystem being coupled to the development subsystem for monitoring toner density in a developed electrostatic image on a photoreceptor belt following the development subsystem of the image reproduction system and further comprising:

an enhanced toner area coverage (ETAC) sensor for generating a voltage signal corresponding to toner density on a photoreceptor belt and the detection subsystem using the voltage signal generated by the ETAC sensor for detecting process direction banding defects on the photoreceptor belt; and the automated compensation subsystem being configured to adjust the charging subsystem, the exposure subsystem, and the DFE/IIT in response to a banding defect being detected by the detection subsystem.

20. The system of claim 17, the detection subsystem being coupled to the development subsystem for monitoring toner density in a developed electrostatic image on a photoreceptor belt following the development subsystem of the image reproduction system and further comprising:

an ETAC sensor attached to a mechanical scanner that moves across the photoreceptor belt to detect cross-process direction banding defects on the photoreceptor belt;

the detection subsystem using the voltage signal generated by the ETAC to detect charging errors in a cross-process direction on the photoreceptor belt that indicate a banding defect has occurred in the developed latent image on the photoreceptor belt; and the automated compensation subsystem being configured to adjust the charging subsystem, the exposure subsystem, and the DFE/IIT in response to a banding defect being detected by the detection subsystem.

* * * * *